US005261584A

United States Patent [19]

Albert

[11] Patent Number: 5,261,584

[45] Date of Patent: Nov. 16, 1993

[54] COLLAPSIBLE MUD PAN BRACKET

[76] Inventor: John L. Albert, 4375 Lathom Rd., Port Alberni, British Columbia, Canada, V9Y 4T1

[21] Appl. No.: 862,104

[22] Filed: Apr. 2, 1992

[51] Int. Cl.[5] ..... A45F 5/00

[52] U.S. Cl. ..... 224/270; 224/197; 224/222; 224/252

[58] Field of Search ..... 224/222, 252, 269, 270, 224/272, 904, 148, 253, 197, 903, 151, 163, 195, 226, 199, 224, 225, 242, 267, 271, 907

[56] References Cited

U.S. PATENT DOCUMENTS

| | | | |
|---|---|---|---|
| 856,243 | 6/1907 | Funk | 224/903 |
| 1,038,750 | 9/1912 | Hill | 224/903 |
| 1,292,728 | 1/1919 | Dozier | 224/253 |
| 1,373,003 | 3/1921 | Hoffman | 224/197 |
| 1,479,008 | 1/1924 | Powers | 224/903 |
| 2,182,194 | 12/1939 | Blau | 224/903 |
| 2,509,428 | 5/1950 | Greene | 224/903 |
| 2,924,364 | 2/1960 | Raguse | 224/253 |
| 2,995,281 | 8/1961 | Dixon | 224/25 |
| 3,090,330 | 5/1963 | Best | 224/270 X |
| 3,326,738 | 6/1967 | McLaughlin | 156/585 |
| 3,541,976 | 11/1970 | Rozas | 224/270 X |
| 3,876,125 | 4/1975 | Emmert | 224/148 |
| 4,106,679 | 8/1978 | Hillinger | 224/197 |
| 4,325,503 | 4/1982 | Swinney | 224/148 |
| 4,972,982 | 11/1990 | Harbour | 224/270 |
| 5,052,603 | 10/1991 | Spina | 224/270 |

FOREIGN PATENT DOCUMENTS

| | | | |
|---|---|---|---|
| 471727 | 2/1929 | Fed. Rep. of Germany | 224/270 |

*Primary Examiner*—Renee S. Luebke
*Attorney, Agent, or Firm*—Barrigar & Oyen

[57] ABSTRACT

A belt-mountable bracket for removably supporting a mud pan for use by construction workers during drywall installation. The bracket is adjustable between a deployed position extending outwardly from the worker's waist belt and a collapsed position resting alongside the worker's body.

10 Claims, 4 Drawing Sheets

COLLAPSIBLE MUD PAN BRACKET

FIELD OF THE INVENTION

This application relates to a belt-mountable bracket adapted to support a conventional plaster or "mud" pan receptacle used by construction workers when installing drywall sheet boards. The bracket is adjustable between a deployed position extending outwardly from the worker's waist belt and a collapsed position resting alongside the worker's body.

BACKGROUND OF THE INVENTION

The interior walls and ceilings of many modern buildings are constructed from sheets of "drywall" or plaster board. The seams between adjacent sheets of drywall must be sealed with drywall tape. Typically, construction workers will also apply a layer of plaster or "mud" to the seams, or to any other uneven sections of the drywall sheets, in order to ensure that the finished wall has a smooth surface. Drywall "mud" is usually carried by the construction worker in a rectangular mud pan receptacle measuring approximately 13"×4"×4" in size. Typically the construction worker holds the mud pan in one hand and applies the mud with a trowel held in the other hand.

The above-described procedure for applying drywall mud is often inconvenient and sometimes dangerous, especially when the worker is standing on a ladder or scaffold. Since both of the worker's hands are occupied with the mud pan and trowel, the worker is not able to safely brace himself against an adjacent wall or the like at the work site. Drywall installation can become even more unwieldy if the worker attempts to apply the seam tape while simultaneously balancing the mud pan and trowel in one hand, or between the worker's legs. As a consequence, it is usually necessary to set the mud pan and trowel down and apply the drywall tape and mud in two separate operations. This is a safer procedure, but it increases drywall installation time.

Some belt-mountable drywall tape dispensers are known in the prior art. For example, U.S. Pat. No. 3,326,738, which issued to McLaughlin on 20 Jun., 1967, discloses a tape dispenser and creaser which includes a first bracket for holding a tape roll and a second bracket for releasably engaging a mud pan. One drawback of the McLaughlin device is that the tape roll may in some instances obstruct access to the mud pan. Further, the McLaughlin device cannot be conveniently folded to a collapsed position when not in use.

Accordingly, the need has arisen for a collapsible bracket for supporting a mud pan in a handy position for use by construction workers when installing drywall sheet boards.

SUMMARY OF THE INVENTION

In accordance with the invention, a bracket mountable on the belt of a user is provided for supporting a receptacle at waist level. The bracket includes securing means for securing the bracket to the user's belt; a frame hingedly coupled to the securing means for removably receiving the receptacle, the frame being swingable between a resting position extending alongside the user's body and a deployed position extending outwardly from the user's body; and support means coupled to the frame for releasably maintaining the frame in the deployed position.

Preferably the support means includes a brace member adapted to bear against one of the user's legs when the frame is in the deployed position and collapsible brace means for coupling the brace member to the frame.

Advantageously, the collapsible brace means is moveable between a bracing position extending beneath the frame for supporting the frame in the deployed position and a collapsed position extending substantially co-planar with the frame when the frame is in the resting position.

In the preferred embodiment, the frame is rectangular and comprises spaced-apart side bars and end bars. The collapsible brace means may include a pair of first rods, each first rod being pivotably coupled to one of the frame side bars; and a pair of second rods, each second rod being slidably coupled to one of the frame side bars.

Preferably the securing means is a belt hook for suspending the bracket on the user's belt. The bracket may also include locking means for releasably coupling the second pair of rods to the belt hook to thereby restrain sliding movement of the second pair of rods when the frame is in the deployed position. The locking means may consist of a fastener extending between the second pair of rods and having a strip of hook-type fastening material on an inner surface thereof for releasably engaging a mating strip of loop-type fastening material located on an outer surface of the belt hook.

The brace member may also include a strap for releasably securing the brace member to one of the user's legs.

In one embodiment of the invention, the bracket may be configured so that the brace means automatically moves to the collapsed position when the receptacle is lifted clear of the frame.

BRIEF DESCRIPTION OF THE DRAWINGS

In drawings which illustrate an embodiment of the invention, but which should not be construed as restricting the spirit or scope of the invention in any way.

DETAILED DESCRIPTION OF THE PREFERRED EMBODIMENT

Figure 1:
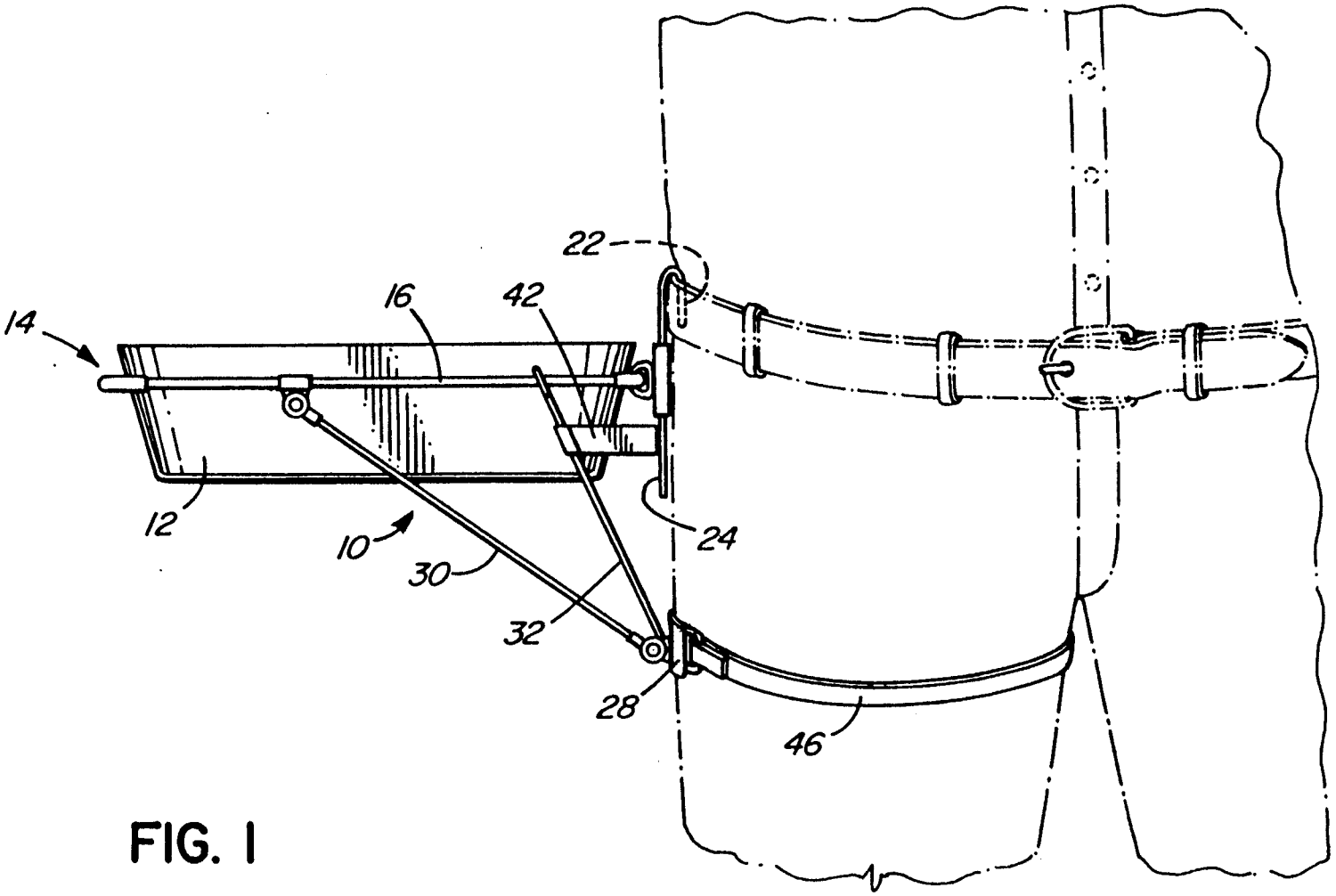
FIG. 1 is a pictorial side view of the belt-mountable bracket of the present invention in its deployed position supporting a mud pan at waist level.

With reference to FIG. 1, this application relates to a bracket 10 for securely supporting a mud pan receptacle 12 on the waist belt of a construction worker (shown in phantom outline). Mud pan 12 is typically used by construction workers when applying plaster or "mud" to the seams between adjacent drywall sheet boards. Bracket 10 is adjustable between a deployed position extending outwardly from the worker's waist belt (FIGS. 1 and 2) and a collapsed position (FIG. 3) resting alongside the worker's body.

Figure 2:
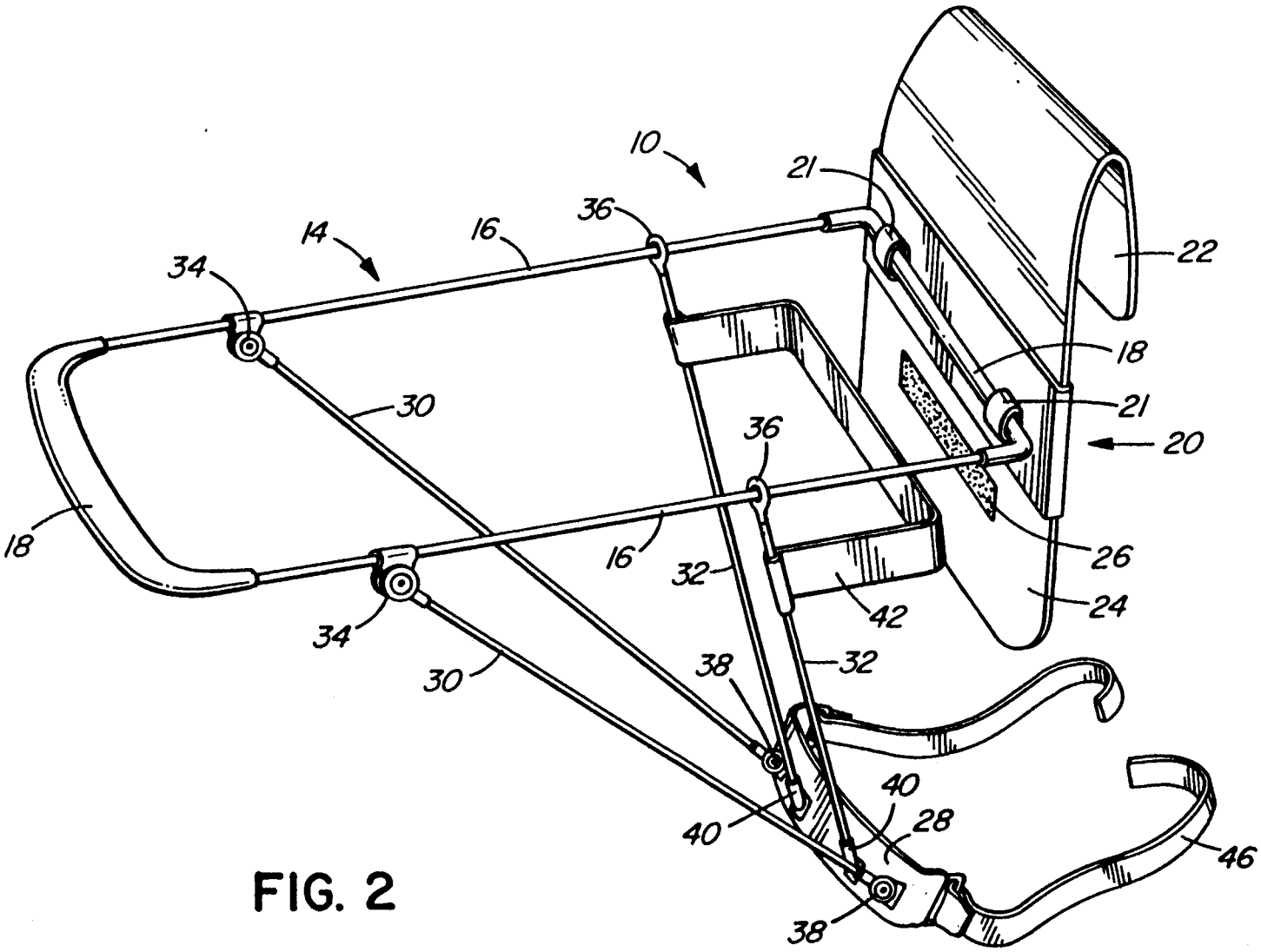
FIG. 2 is a an isometric view of the mud pan bracket of FIG. 1 in its deployed position.
Figure 5:
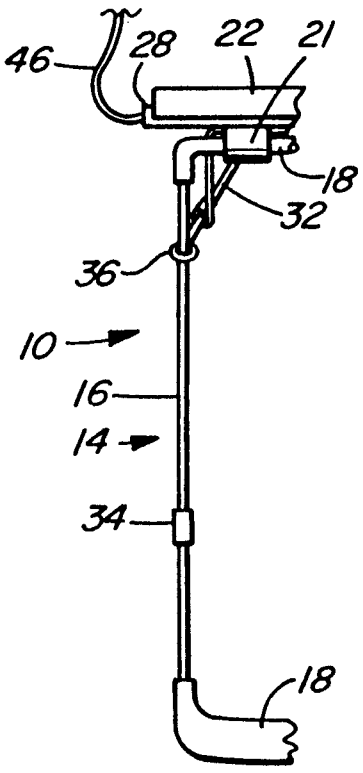
FIG. 5 is a top, plan view of the mud pan bracket of FIG. 1.

As shown best in FIGS. 2 and 5, bracket 10 includes a rectangular frame 14 consisting of side rods 16 and end rods 18. Frame 14 is preferably sized so that it is slightly smaller then the upper rim of a conventional mud pan 12 (i.e. approximately 13"×4"×4").

One end rod 18 of frame 14 is hingedly coupled to a belt clip 20, such as by apertured connectors 21 (FIG. 2). Accordingly, frame 14 can swing relative to connectors 21 between the outwardly extending, deployed position shown in FIGS. 1 and 2 and the folded, collapsed position shown in FIG. 3.

As shown best in FIG. 1, belt clip 20 includes a bent-over portion 22 which may be hooked over the worker's belt. As discussed in further detail below, belt clip 20 also includes a lower portion 24 having a strip 26 of loop-type VELCRO TM material on its outer surface.

Bracket 10 also includes "support means" for releasably maintaining frame 14 in the deployed position. The support means includes a moulded leg brace 28 which is connected to frame 14 with a first pair of brace rods 30 and a second pair of brace rods 32. More particularly, the upper ends of rods 30 are pivotably coupled to respective frame side bars 16 with connectors 34, which are mounted on side bars 16 at a fixed longitudinal position. The upper ends of rods 32 are slidably coupled to side bars 16 with apertured connectors 36. As shown in FIG. 2, the lower ends of brace rods 30, 32 are securely coupled to the outer surface of leg brace 28 with connectors 38 and 40 respectively.

Figure 3:
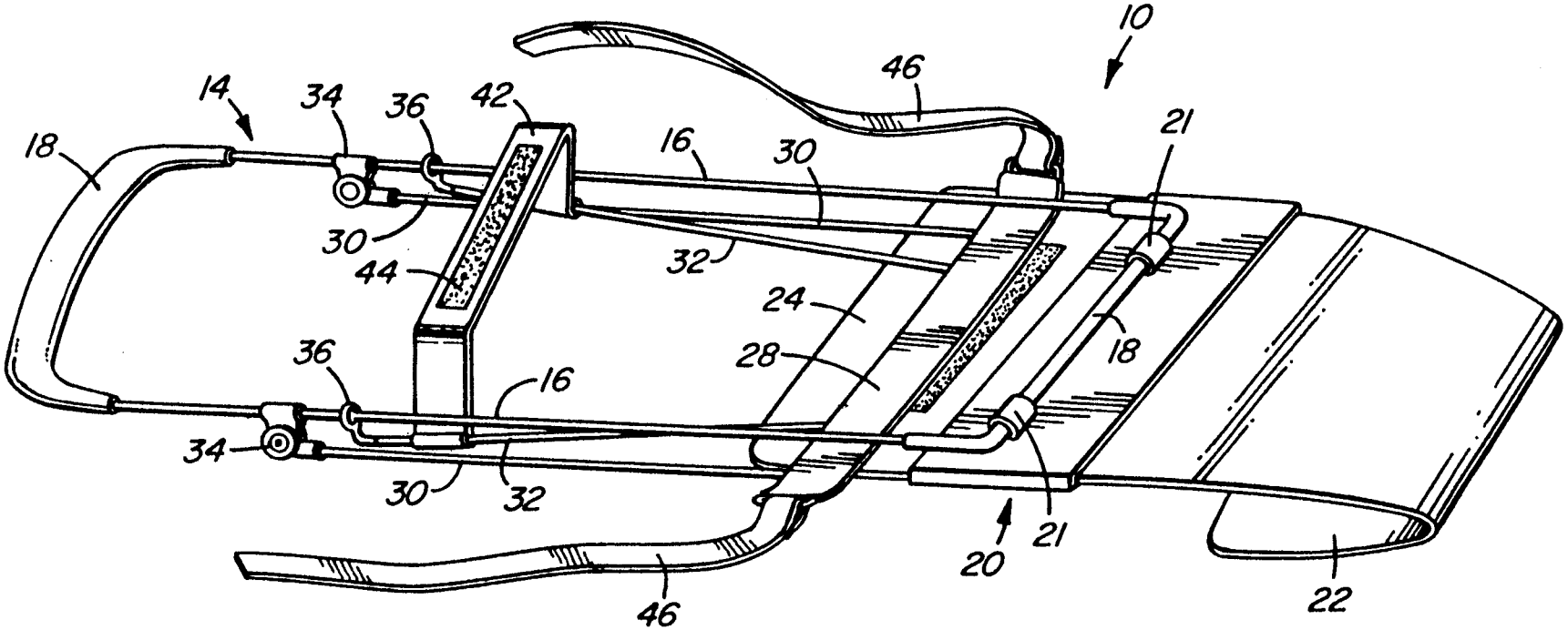
FIG. 3 is an isometric view of the mud pan bracket of FIGS. 1 and 2 in its collapsed position.

The support means also includes a semi-rigid, U-shaped fastener 42 for releasably coupling brace rods 32 to belt clip 20. As shown best in FIGS. 1 and 2, fastener 42 extends between the upper ends of rods 32 proximate connectors 36. As shown in FIG. 3, fastener 42 has a strip of hook-type VELCRO TM material 44 on its inner surface which is releasably connectible to VELCRO TM strip 26 located on the outer surface of belt clip 24 (FIG. 2).

The purpose of fastener 42 is to lock frame 14 in the extended, deployed position shown in FIG. 1 by restraining sliding movement of brace rods 32. Optionally, leg brace 28 includes a strap 46 which the worker fastens around the thigh of one leg to also help maintain bracket 10 in the deployed position. The free ends of strap 46 are preferably fitted with quick release fasteners, such as mating strips of VELCRO TM material.

Bracket 10 may be readily adjusted from the deployed position shown in FIGS. 1 and 2 to the collapsed position shown in FIG. 3, by lifting mud pan 12 clear of frame 14, releasing the free ends of leg strap 46, and detaching VELCRO TM strip 44 on fastener 42 from the mating VELCRO TM strip 26 on belt clip 24. The worker can then slide connectors 36 outwardly along the longitudinal axes of frame side bars 16 toward connectors 34 (i.e. in the direction of the arrow shown in FIG. 4). This allows brace rods 30 and attached leg brace 28, to pivot upwardly about connectors 34. As brace rods 30 and 32 are collapsed together as described above, gravitational forces will cause frame 14 to swing about connectors 21 from the generally horizontal, outwardly extending position shown in FIGS. 1 and 2, to the generally vertically extending, collapsed position (shown in FIG. 3) resting alongside the user's hips. In the fully collapsed position, frame side bars 16 and brace rods 30, 32 extend in substantially the same vertical plane. Bracket 10 may be collapsed as described above without detaching belt clip 20 from the worker's belt.

In operation, bracket 10 is adapted for use by construction workers installing drywall sheet boards. Initially, bracket 10 is in the collapsed position shown in FIG. 3. In order to use bracket 10, the worker first hooks the bent-over portion 22 of belt clip 20 over his or her waist belt (FIG. 1). The worker then swings bracket frame 14 upwardly about connectors 21 toward the outwardly extending, deployed orientation shown in FIGS. 1 and 2 while simultaneously pivoting leg brace 28 downwardly about connectors 34. As leg brace 28 pivots downwardly, connectors 36 coupling brace bars 32 to frame side bar 16 slide inwardly toward belt clip 20. The worker then places leg brace 28 in a comfortable position against the outer surface of one leg as shown in FIG. 1 and fastens the free ends of strap 46. Brace 28 is preferably moulded to conform to the curvature of the worker's leg for greater comfort.

The worker next couples fastener 42 to belt clip 20 by fastening VELCRO TM strips 44 and 26 together as described above. This releasably locks frame 14 in the extended, deployed position by restraining sliding movement of brace rods 32.

Figure 4:
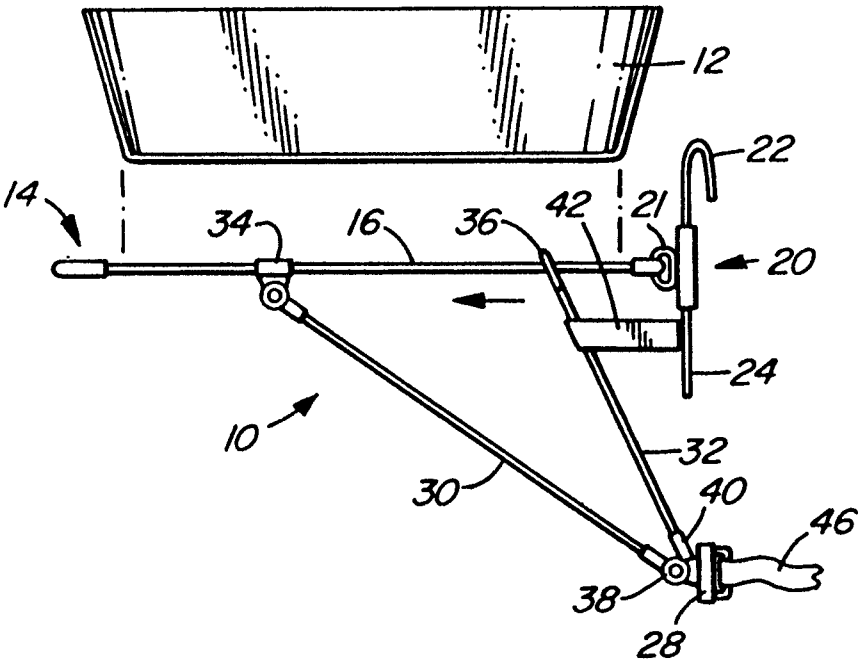
FIG. 4 is a side elevational view of the bracket of FIG. 1 with the mud pan shown raised above the bracket.

Finally, the worker places the loaded mud pan 12 into bracket frame 14 as shown in FIG. 4. The dimensions of frame 14 are slightly less than mud pan 12 to ensure that pan 12 is maintained snugly in place by gravitational forces.

The worker may then conveniently apply "mud" or plaster from pan 12 to the drywall sheets in question with a trowel in the usual manner. This leaves one of the worker's hands free to brace himself against a wall, ladder or scaffold at the work site. When not in use, the trowel may be placed within mud pan 12, thus leaving both of the worker's hands free to apply drywall tape or perform other tasks. Since mud pan 12 is securely supported by bracket 10 in the deployed position (FIG. 1), the worker need not set mud pan 12 down or attempt to balance it between his or her legs as is the current practice.

When not in use, such as when mixing plaster or "mud", bracket 10 may be conveniently returned to the collapsed position shown in FIG. 3 resting alongside the worker's body. As discussed above, the worker need only release leg strap 46 and detach VELCRO TM strip 44 located on the inner surface of fastener 42 from the mating VELCRO TM strip 26 located on a outer surface of belt clip 20. In order to remove bracket 10 entirely, belt clip 20 may be lifted clear of the worker's waist belt.

As should be apparent from the above description, many variations and modifications may be made to the invention without departing from the spirit or scope thereof. For example, a spring mechanism could be provided for biasing bracket 10 toward the deployed position or for automatically pivoting bracket 10 to the collapsed position when pan 12 is lifted clear of frame 14 as in FIG. 4. Similarly, other equivalent mechanisms could be provided for locking bracket 10 in the deployed position. Further, although bracket 10 has been described above with reference to a mud pan 12, it should be apparent that the same inventive principles could be applied to support trays for holding paint, varnish, glue and the like.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A bracket mountable on a belt secured to a body of a user for supporting a receptacle at waist level, said bracket comprising:

(a) securing means for securing said bracket to the user's belt;

(b) a frame hingedly coupled to said securing means for removably receiving said receptacle, wherein said frame is swingable between a resting position extending alongside the user's body and a deployed position extending outwardly from the user's body; and (c) collapsible support means coupled to said frame and moveable between a bracing position extending beneath said frame for supporting said frame in said deployed position and a collapsed position extending substantially co-planar with said frame when said frame is in said resting position, wherein said support means comprises:

(a) a brace member adapted to bear against a leg of the user when said frame is in said deployed position; and (b) coupling means for coupling said brace member to said frame.

2. The bracket as defined in claim 1, wherein said brace member further comprises a strap for releasably securing said brace member to one of the user's legs.

3. The bracket as defined in claim 1, further comprising locking means formed on said frame for releasably locking said support means in said bracing position.

4. The bracket as defined in claim 1, wherein said frame is rectangular and comprises spaced-apart side bars and end bars.

5. The bracket as defined in claim 4 wherein said coupling means comprises:

(a) a pair of first rods, each first rod being pivotably coupled to one of said frame side bars; and (b) a pair of second rods, each second rod being slidably coupled to one of said frame side bars.

6. A bracket as defined in claim 5, further comprising locking means for restraining movement of said rods relative to said frame side bars.

7. The bracket as defined in claim 5, wherein said securing means comprises a hook for suspending said bracket on said belt.

8. The bracket as defined in claim 7, further comprising locking means for releasably coupling said pair of second rods to said hook to thereby restrain sliding movement of said second pair of rods when said frame is in said deployed position.

9. The bracket as defined in claim 8, wherein said locking means comprises a fastener extending between said pair of second rods and having a strip of hook-type fastening material for releasably engaging a mating strip of loop-type fastening material located on said hook.

10. A bracket mountable on a belt secured to a body of a user for supporting a receptacle at waist level, said bracket comprising:

(a) securing means for securing said bracket to the user's belt;

(b) a frame for removably receiving said receptacle, said frame having a first end and a second end;

(c) a hinge for hingedly coupling said frame first end to said securing means, wherein said frame is swingable about said hinge between a resting position extending alongside the user's body and a deployed position extending outwardly from the user's body; and (c) support means coupled to said frame for releasably maintaining said frame in said deployed position, wherein said support means is connectible to said frame at a position remote from said hinge and wherein said support means comprises:

(a) a brace member adapted to bear against a leg of the user beneath said frame when said frame is in said deployed position; and (b) coupling means for coupling said brace member to said frame.

* * * * *